United States Patent [19]

Pitts

[11] Patent Number: 5,056,410

[45] Date of Patent: Oct. 15, 1991

[54] FIREARM RECOIL ABSORBER

[75] Inventor: Homer E. Pitts, Eugene, Oreg.

[73] Assignee: Zero Coil, Inc., Eugene, Oreg.

[21] Appl. No.: 410,816

[22] Filed: Sep. 22, 1989

[51] Int. Cl.[5] ..... F41A 23/16

[52] U.S. Cl. ..... 89/37.04; 89/44.01

[58] Field of Search ..... 89/37.04, 44.01, 198, 89/44.02, 42.01; 42/94; 73/167

[56] References Cited

U.S. PATENT DOCUMENTS

| | | | |
|---|---|---|---|
| 32,762 | 7/1861 | Fuller | 89/44.01 |
| 522,508 | 7/1894 | Canet | 89/44.01 |
| 1,367,353 | 2/1921 | Craig | 73/167 |
| 1,457,407 | 6/1923 | Stokes | 89/37.04 |
| 1,757,244 | 5/1930 | Green | 89/44.01 |
| 2,339,226 | 1/1944 | Trotter | 89/42.01 |
| 2,378,545 | 6/1945 | Fraser et al. | 73/167 |
| 2,427,365 | 9/1947 | Meister | 42/94 |
| 2,599,265 | 6/1952 | Leek | 89/43 |
| 2,731,829 | 1/1956 | Wigington et al. | 73/167 |
| 2,817,233 | 12/1957 | Dower et al. | 73/167 |
| 2,831,404 | 4/1958 | Sampson et al. | 89/189 |
| 2,966,829 | 1/1961 | Tannenbaum | 89/43 |
| 3,225,656 | 12/1965 | Flaherty et al. | 42/94 |
| 3,805,608 | 4/1974 | Schmidt et al. | 73/167 |
| 3,876,078 | 4/1975 | Gromes et al. | 42/94 |
| 4,333,385 | 6/1982 | Culver | 89/37.04 |
| 4,893,545 | 1/1990 | Sanderson et al. | 89/44.01 |

FOREIGN PATENT DOCUMENTS

| | | | |
|---|---|---|---|
| 29362 | 7/1907 | Austria | 42/94 |
| 67463 | 4/1914 | Austria | 89/37.04 |
| 1578379 | 8/1970 | Fed. Rep. of Germany | 89/44.01 |
| 972202 | 1/1951 | France | 89/44.01 |
| 81822 | 5/1953 | Norway | 89/37.04 |
| 7149 | of 1898 | United Kingdom | 89/37.04 |

OTHER PUBLICATIONS

"Weatherby Hunter's Notebook: Facts About Recoil", *Petersen's Hunting*, Dec. 1988, p. 68.

Brownells, Inc. Catalog No. 41, four pages including cover and title pages and p. 149.

*Primary Examiner*—Deborah L. Kyle

*Assistant Examiner*—Stephen Johnson

*Attorney, Agent, or Firm*—Klarquist, Sparkman, Campbell, Leigh & Whinston

[57] ABSTRACT

A firearm recoil absorbing device for supporting a firearm during firing includes nested inner and outer frames. The inner frame is slidably connected to the outer frame by plural rollers for relative sliding motion between the nested frames. Each frame includes two opposing sidewalls interconnected by opposing front and rear walls. A stop is mounted to the outer frame and extends into the inner frame. The stop divides the space within the inner frame into a recoil chamber and a return chamber located respectively toward the front and rear walls. One or more rods, mounted to the inner frame front wall, extends parallel to the sidewalls of each frame and slidably through the stop and the rear walls of each frame. A recoil spring surrounds the rod in the recoil chamber and a return spring surrounds the rod in the return chamber. When used to fire a rifle or shotgun having a barrel end supported by sandbags or a shooter's hand, the device includes a butt cup mounted to the inner frame for receiving and supporting the firearm shoulder stock butt. In alternative embodiments, the firearm butt cup may be self-aligning or adjustable. During firing, the recoil spring absorbs the recoil energy as the inner frame is forced from a forwardmost position to a rearward position and then returns the inner frame to the forwardmost position. The return spring counteracts the recoil spring to ease the return of the inner frame to the forwardmost position.

18 Claims, 4 Drawing Sheets

FIREARM RECOIL ABSORBER

BACKGROUND OF THE INVENTION

The present invention relates generally to a device for supporting firearms, such as rifles and shotguns, during test firing, and more particularly to an improved portable device for absorbing firearm recoil during test firing.

Hunters and target shooters often need to test fire their guns at a fixed target from a secure, stable or "benched" position for various purposes, such as evaluating ammunition loads and adjusting sights or scopes (known as "sighting-in"). The goal of such bench firing is to eliminate external variables, such as the technique of the shooter, which may adversely effect the trajectory of a fired projectile.

To facilitate repeated firings from a benched position, a mechanical device is often used to support the firearm. Such devices typically support the firearm at one or more points to aid in achieving the desired stability upon firing. These devices range from simple sand bags to complex bench-mountable recoil absorbing devices.

During test firing, the shooter often prefers to grip the firearm in a fairly normal manner, that is, to the extent permitted by the supporting apparatus. However, after a series of test firings, the shooter's shoulder may become quite sore from absorbing the recoil of the firearm held in an unnatural position dictated by the supporting device. This is particularly true when test firing high power rifles or magnum ammunition loads. Thus, it is desirable to reduce or eliminate the recoil to allow the shooter to fire as many rounds as necessary without suffering any resulting soreness.

During test firing for sighting-in a firearm or scope, the shooter must view down the sight path from a normal firing position. However many known supporting devices are so bulky and cumbersome that the shooter cannot attain nor maintain a clear, comfortable sighting position.

Some known supporting devices progressively absorb the firearm recoil force after firing as the firearm travels from an initial rest position prior to firing to a rearmost recoil position. However, no control is provided for returning the firearm from the rearmost recoil position forward to the initial rest position. Such uncontrolled return motion results in harsh reciprocation and jarring impacts of the device and firearm as the apparatus reaches a resting point. Such severe mechanical impacts may damage the components of a scope mounted to the test firearm.

Additional drawbacks of known supporting devices include time-consuming, complex means of securing the device to a bench, often requiring special tools or fasteners. Furthermore, some devices require perfectly level or specially contoured surfaces upon which they must be mounted. Such requirements seriously detract from the usefulness of the device, particularly for shooters using a variety of shooting ranges with varying facilities.

One such known device for supporting a rifle during accuracy testing is disclosed in U.S. Pat. No. 3,805,608 to Schmidt et al. A frame has two parallel shafts slidably mounted thereon at each end by fore and rear sets of bearings to move longitudinally relative to the frame. To secure a firearm, a butt clamp and a fore clamp are each rigidly mounted on opposing ends of the two parallel shafts adjacent the bearings, with the butt clamp outboard of the rear bearings and the fore clamp inboard of the fore bearings. Each shaft has a concentric spring retaining collar rigidly mounted thereon between the butt and fore clamps, and toward the butt clamp end of each shaft. Each shaft has a spring concentrically mounted thereon between the rear bearings and the spring retaining collar.

The Schmidt et al. device suffers from several disadvantages. For example, the firearm recoil energy induces relative motion between the shafts and frame which is absorbed by the two springs. After arresting the rearward recoil motion, the device fails to provide any means for controlling the forward acceleration of the shafts as the springs release the stored recoil energy. The forward motion is only stopped when the butt clamp abruptly impacts with the rear bearings which may damage the device, the firearm or any scope mounted thereto. The butt clamp also includes a rearwardly protruding bolt which prevents a shooter from shouldering and properly sighting the firearm in a conventional manner. Furthermore, the frame requires the use of bolts and a special mounting surface having corresponding bolt holes therethrough for mounting the device.

Another known apparatus for supporting a rifle during test firings is shown in U.S. Pat. No. 4,333,385 to Culver. Two parallel rails are rigidly mounted at each end by abutments to a base. A carriage, having fore and rear sliders with bearings mounted therein, is slidably mounted by the sliders to the rails between the abutments. A butt clamp and a fore clamp are mounted generally above the respective rear and fore sliders to support a firearm. A foamed block plastic cushion surrounds each end of the rails in a space between each slider and the adjacent abutment to absorb the recoil energy.

The Culver device also suffers several disadvantages. For example, the device is not durable, as the foam block cushions will wear and degrade over time, such as by taking a permanent compressed set, inhibiting the recoil absorbing function. Furthermore, the butt clamp includes a rearwardly extending toggle and an angle adjustment knob, which, in addition to the generally bulky form of the apparatus, prevents a shooter from shouldering the firearm during test firing. The base also includes a downwardly projecting flange which extends over a front edge of a mounting surface to prevent rearward travel of the apparatus during firing. This requires the mounting surface to have a proper width for convenient use of the flange along with bolt holes to mount the apparatus thereto.

A pistol supporting device is shown in U.S. Pat. No. 2,731,829 to Wigington et al. This device has two parallel rails rigidly mounted at each end to a base by fore and aft transverse bracket bars. The device also includes a pistol-supporting carriage slidably mounted to the rails and biased toward the fore bracket bar by two recoil absorbing springs, each mounted to one of the rails. Adjustment collars may be inserted between the springs and aft bracket bar, or between the fore bracket bar and carriage, to very the spring tension.

The Wigington et al. device also has a variety of disadvantages. For example, the pistol stocks must be removed prior to mounting the pistol. This is excessively time consuming and prohibits holding the firearm in a normal fashion. Furthermore, no damping is provided for returning the carriage from a rearmost position after firing back to the initial position adjacent the fore bracket bar. Also the base must disadvantageously be bolted to a mounting surface having pre-drilled holes therethrough.

Other known devices include electro-pneumatic recoil absorbers for quality control testing by firearm manufacturers, gun-mounted recoil buffers for machine guns, and recoil mechanisms for tank-mounted U.S. Pat. Nos. 2,599,265, 2,831,404 and 2,966,829.

Thus, a need exists for an improved firearm recoil absorbing device which is not susceptible to the above limitations and disadvantages.

SUMMARY OF THE INVENTION

It is an overall object of the present invention to provide an improved firearm recoil absorbing device for supporting a firearm during firing.

An additional object of the present invention to provide a firearm recoil absorbing device of simplified construction, with few parts, that is relatively inexpensive to manufacture.

Another object of the invention is to provide a recoil absorbing device that effectively absorbs firearm recoil energy and controls the return motion of the device components to an initial position after firing.

A further object of the invention is to provide a portable recoil absorbing device that is compact and readily mountable to test surfaces of widely varying dimensions, such as may be encountered at various firing ranges, without using tools or fasteners.

Still another object of the invention is to provide an ambidextrous recoil absorbing device which allows a shooter to grasp and fire the firearm in a conventional manner.

Another object of the invention is to provide a recoil absorbing device which allows a shooter to grasp the firearm in a conventional manner and fire without suffering the often painful and fatiguing full effect of the firearm recoil.

Yet a further object of the invention is to provide a recoil absorbing device which allows a shooter to grasp the firearm in a conventional manner and learn basic shooting techniques without fearing the recoil.

A further object of the invention is to provide a variable recoil absorbing device which allows a shooter to learn basic shooting techniques, wherein the recoil felt by the shooter may be increased as the shooter's learning progresses.

An additional object of the present invention is to provide a versatile firearm recoil absorbing device which may be used with a variety of firearms without requiring time-consuming mounting procedures or modifications of the device for each firearm.

A further object of the present invention is to provide a recoil absorbing device which minimizes the rearward travel of a firearm during firing.

Still another object of the present invention is to provide a recoil absorbing device which minimizes the possibility of a scope mounted to a firearm lacerating a shooter's face or eye during firing, and which minimizes a phenomenon known as "heart-beat bump", wherein the cross-hairs of a scope move upward in response to a shooter's heart beat. Such injuries and phenomena often occur when shooting high power rifles with suitable scopes, such as may be used on safari for elephant and other large game.

Yet a further object of the present invention is to provide a self-aligning recoil absorbing device.

An additional object of the present invention is to provide an adjustable recoil absorbing device.

According to one aspect of the present invention, a firearm recoil absorbing device for supporting a firearm during firing includes nested inner and outer frames. The inner frame is slidably connected to the outer frame for relative sliding motion between the nested frames. The device also includes firearm receiving means extending upwardly from the inner frame for receiving the firearm. The device further includes recoil energy absorbing spring means resiliently interconnecting or coupling the inner and outer frames for absorbing the recoil energy from the firearm during firing.

According to another aspect of the present invention, a firearm recoil absorbing device for supporting a firearm during firing includes a frame and a stop mounted to the frame. The device also includes firearm support means slidably mounted to the frame for receiving a firearm aimed in a forward direction. The device also includes first and second recoil absorbing spring means. The first recoil absorbing spring means is positioned between the stop and the firearm support means. This first spring means is provided for absorbing recoil energy as the support means slides as a result of firing in a rearward direction opposite the forward direction. The second recoil absorbing spring means is positioned between the stop and a second portion of the firearm support means. This second spring means is provided for absorbing energy as the support means returns in the forward direction following firing.

According to a further aspect of the present invention, a portable firearm recoil absorbing device is provided for supporting a firearm during firing. This portable device includes a frame and firearm support means mounted to the frame for receiving the firearm. The device further includes shock absorbing means mounted to the frame for absorbing the shock during firing. The device also has clamping means mounted to the frame for releasably clamping the device to a test surface.

In an illustrated embodiment, the recoil absorbing device described above includes roller means for slidably engaging the inner and outer frames to allow relative sliding motion therebetween. The device also includes guide means, such as one or more rods, extending through the stop for supporting and guiding the recoil energy shock absorbing means.

In further illustrated embodiments, the firearm recoil absorbing device described above may be used with a firearm having a barrel end terminating at a muzzle and a shoulder stock which terminates at a butt, such as a rifle or shotgun. For this type of firearm, the device may be used in conjunction with external support means for supporting the barrel end. In one embodiment, the firearm support or receiving means comprises self-aligning butt cup means for receiving the firearm butt. In this embodiment, the vertical adjustment of the muzzle is provided by vertically adjusting the external support means. In an alternate embodiment, the firearm support means includes adjustable butt cup means for receiving the firearm butt to provide vertical adjustment of the muzzle in cooperation with the external support means.

These and other objects, features and advantages of the present invention will become apparent to those skilled in the art from the following detailed description and drawings.

DETAILED DESCRIPTION OF THE PREFERRED EMBODIMENTS

Figure 1:
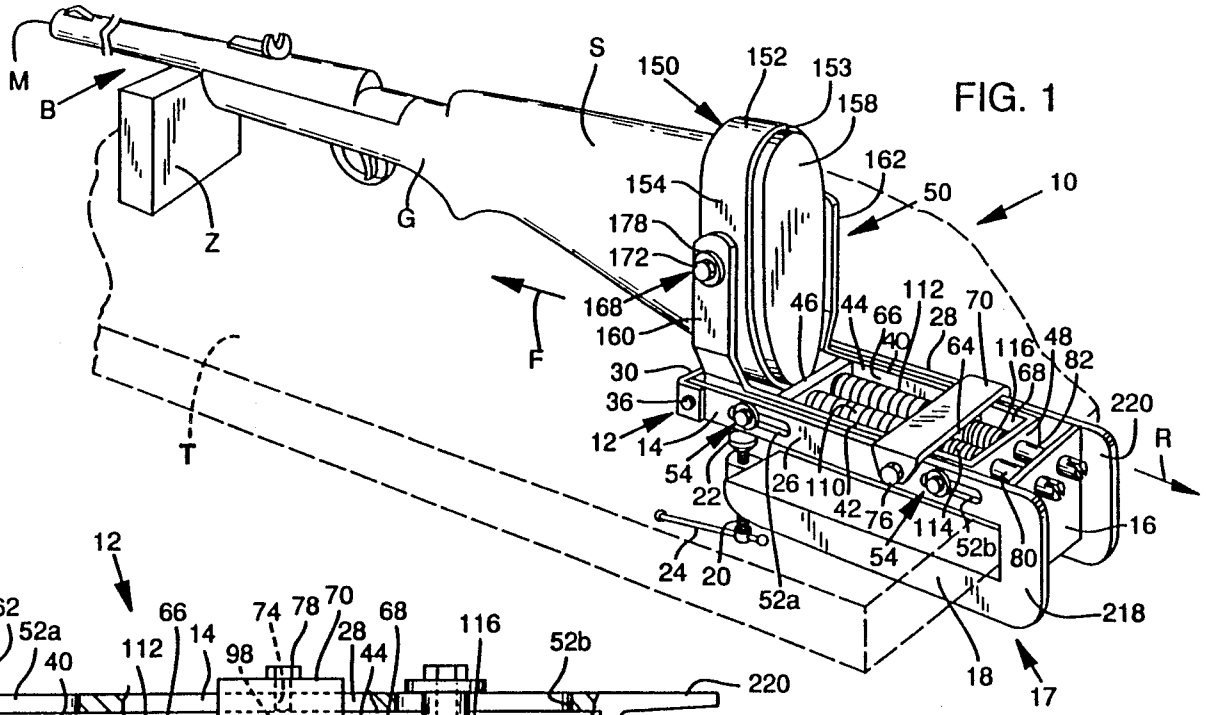
FIG. 1 is a perspective view of one form of the present invention shown fastened to a surface, and having a self-aligning butt cup shown supporting the butt of a firearm.
Figure 3:
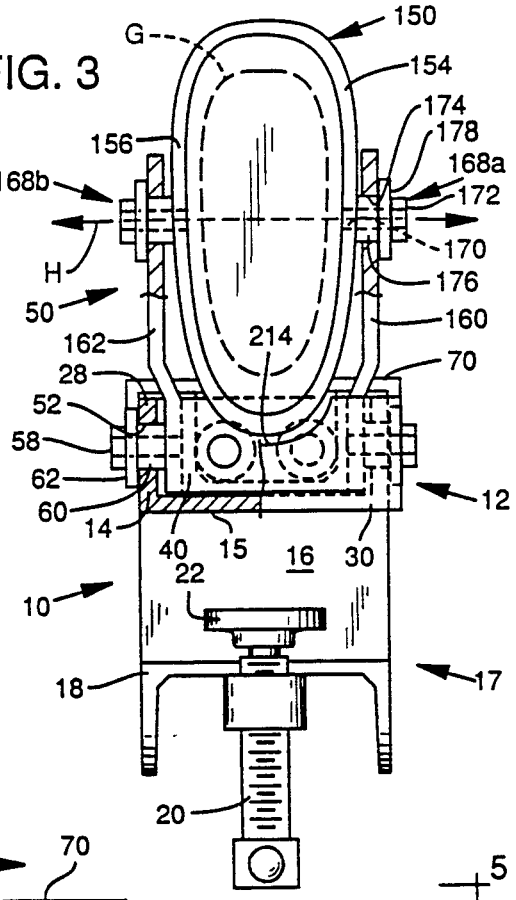
FIG. 3 is a partially cutaway front elevational view taken along line 3—3 of FIG. 2.

FIGS. 1–4 illustrate one embodiment of a firearm recoil absorbing device 10 which has an upper recoil assembly 12 that includes an outer stationary frame 14. The illustrated outer stationary frame 14 is of an open-box-like construction and has a lower wall 15 and a rear wall 16. The recoil absorbing device 10 has self-contained mounting or clamping means, such as a C-clamp type fastener 17, for releasably clamping the device to a test surface, such as a shooting bench, tabletop or test surface T. As best seen in FIGS. 1 and 3, the C-clamp fastener 17 is formed by the stationary frame lower wall 15, a portion of rear wall 16, and a lower leg 18. To secure the device in place on bench T during shooting, lower leg 18 threadably engages a threaded portion of a clamping screw 20 having a bench-engaging platform 22 at one end, and a tightening handle 24 at the opposing end.

A clamping means allows the advantageous and convenient use of the device with a variety of shooting benches T having varying thicknesses or recessed undersurfaces. Thus, the device is both portable and versatile, and may be used without damaging or altering the shooting bench. Also, the speed and ease of mounting and removing the device from the bench allows for more efficient use of shooting range time, that is, the available time may be spent shooting instead of setting up the device.

Figure 5:
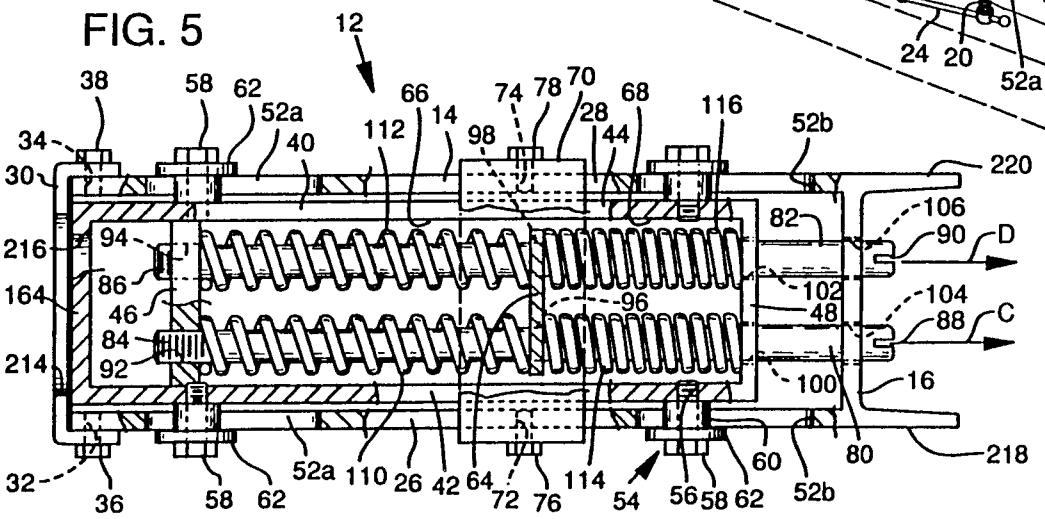
FIG. 5 is a partially cutaway top plan view taken along line 5—5 of FIG. 2.
Figure 4:
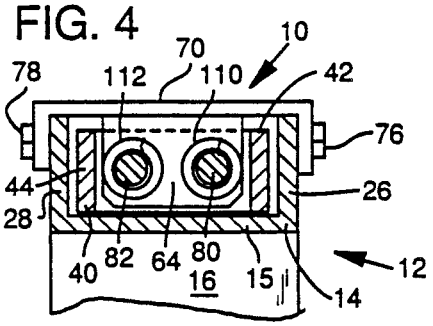
FIG. 4 is a cross sectional view taken along line 4—4 of FIG. 2.

Referring also to FIG. 5, the stationary frame 14 has opposing sidewalls 26, 28 interconnected by a front wall 30 which is opposite the rear wall 16. Each frame sidewall 26, 28 has an internally threaded hole 32, 34, respectively, therethrough near a front or forwardmost end of the sidewall. The front wall 30 is attached to each sidewall 26, 28 by bolts 36, 38 which threadably engage the respective holes 32, 34. Alternatively, the front wall 30 may be integrally formed with sidewalls 26, 28 (not shown).

The upper recoil assembly 12 further includes firearm support means, such as an open-box-like inner carriage frame 40, which is nested within and slidably mounted to the outer frame 14, for receiving a firearm or gun G aimed in a forward direction, indicated by arrow F in FIG. 1. Preferably the carriage frame 40 and outer frame 14 are each elongated and are of a low profile construction so that they do not project upwardly into the space immediately behind a gun butt positioned as explained below. Consequently, the frames 14, 40 do not interfere with the positioning of a shoulder against the gun butt. The carriage frame 40 has opposing sidewalls 42, 44 interconnected by opposing front and rear walls 46 and 48, respectively. The carriage frame sidewalls 42, 44 are adjacent and shorter in length than the respective outer frame sidewalls 26, 28 to allow for relative forward and rearward sliding motion (see respective arrows F and R in FIG. 1) between the nested frames.

The firearm support means further includes firearm receiving means 50, extending upwardly from the inner frame 40 adjacent front wall 46, for receiving the firearm G. Two alternate embodiments of firearm receiving means will be discussed further below, with item 50 referring to the embodiment illustrated in FIGS. 1–3, and item 50' referring to an alternate embodiment illustrated in FIGS. 7 and 8.

The upper recoil assembly 12 also has roller means for slidably interconnecting and coupling the outer frame sidewalls 26, 28 with the respective inner frame sidewalls 42, 46. The roller means facilitates the relative sliding motion between the nested frames 14 and 40 in a direction substantially parallel to the sidewalls. The illustrated roller means includes a roller supporting means associated with each stationary frame sidewall 26, 28, such as a horizontal longitudinal slots **52*a* and 52*b* located near opposite ends of each sidewall. The perimeter of the slots 52*a*, 52*b*** forms a roller-engaging surface.

The illustrated roller means also includes roller assemblies 54 extending outwardly from the respective carriage frame sidewalls 42 and 44, into rolling engagement with slots **52*a*, 52*b*. These roller assemblies allow the inner frame 40 to move between forwardmost and rearwardmost positions within the confines of the stationary frame 14**.

Referring to FIG. 5, each illustrated roller assembly 54 includes a bolt 58 having a shank which serves as a bearing surface for a roller 60. The bolt 58 and roller 60 extend through slot 52, with the bolt 58 threadably engaging a hole 56 in an associated frame sidewall. The roller assembly 54 also includes a washer 62, seated between the head of bolt 58 and the outer frame sidewall. The washer 62 has an outer diameter greater than the vertical depth of slot 52, which facilitates smooth operation of the device by securing the transverse position of the carriage frame 40 with respect to the stationary frame 14 (see FIGS. 1 and 2).

The roller 60 may be a bushing, a bearing assembly comprising needle or roller bearings, or the like. Alternatively, the shank of bolt 58 may slide directly in contact with the slot. However, to prevent undue wear of the bolt and provide for a smoother operation of the device, inclusion of the roller 60 is preferred. Clearly, alternate roller or sliding means, such as rollers engaging rails, may be located, for example, between the inner and outer frame sidewalls or between the inner frame undersurface and the outer frame lower wall 15.

The upper recoil assembly 12 further includes shock or recoil energy absorbing means resiliently interconnecting the inner and outer frames 40, 14 for absorbing the shock or recoil energy from the firearm G during firing. The assembly 12 also includes inner frame divider means, such as a stop 64, rigidly mounted to the outer frame 14 and extending into the inner frame 40, for dividing the space within the inner frame into a recoil chamber 66 and a return chamber 68. The recoil chamber 66 is defined by the carriage frame sidewalls 42, 44, the front wall 46, and the stop 64. Similarly, the return chamber 68 is defined by the carriage frame sidewalls 42, 44, rear wall 48 and stop 64.

In the illustrated embodiment, to mount the stop 64 to the stationary frame 14, the stop has a stop upper housing member 70 which extends over the width of both the inner and outer frames 40, 14. The undersurface of housing member 70 is generally perpendicular to stop 64 and contacts the upper edges of each stationary frame sidewall 26, 28. The housing member 70 has two downwardly projecting ears, each of which lie adjacent the outer surface of the respective stationary frame sidewalls 26, 28. Each sidewall 26, 28 has an internally threaded hole 72, 74, respectively, therethrough. Each ear of the stop housing member 70 has a hole therethrough, and each ear receives a bolt 76, 78 which threadably engages the respective holes 72, 74. Thus, the stop 64 is securely mounted to the outer frame 14.

The upper recoil assembly 12 also includes guide means, such as a rod 80 extending through the stop 64, for supporting and guiding the shock absorbing means. In the illustrated embodiment, the guide means includes two parallel rods 80, 82, each having respective first and second longitudinal axes C and D (see FIG. 5). Each rod 80, 82 has a respective threaded end 84, 86 and an opposing end having means for rotating each rod, such as the respective slots 88, 90.

The guide rods 80 and 82 may be detachably attached to the upper recoil assembly 12, such as in the following manner. The inner frame front wall 46 has two internally threaded holes 92, 94 therethrough which threadably engage the respective threaded ends 84, 86 of the guide rods. The stop 64 has two holes 96, 98 therethrough; the inner frame rear wall 48 has two holes 100, 102 therethrough; and outer frame rear wall 16 has two holes 104, 106 therethrough. The holes 96, 100 and 104 are centered about the first longitudinal axis C and sized to slidably receive rod 82. The holes 98, 102 and 106 are centered about the second longitudinal axis D and sized to slidably receive rod 82.

When assembled with the roller assemblies 54 in place, the rods 80 and 82, as well as axes C and D, are substantially parallel to the sidewalls of each of the nested frames 14, 40. Also, the rods are sized in length to extend through holes 104 and 106 when the inner frame 40 is in a forwardmost position toward the outer frame front wall 30. The guide rods 80, 82 may be mounted to and detached from the inner frame front wall 46 by rotating the rods at the respective notches 88 and 90.

In the illustrated embodiment, the shock or recoil energy absorbing mean's mentioned above may comprise recoil absorbing spring means, such as recoil springs 110 and 112 surrounding the respective rods 80 and 82 in the recoil chamber 66. The recoil springs 110 and 112 extend from the inner frame front wall 46 to stop 64. The recoil energy absorbing means may also include second recoil absorbing or return spring means, such as springs 114 and 116 surrounding the respective rods 80 and 82 in the return chamber 68. The return springs 114 and 116 extend from the stop 64 to the inner frame rear wall 48.

The recoil springs 110 and 112 are provided for absorbing the recoil energy produced by the firearm during firing. From the initial forwardmost position, this recoil energy forces the inner frame 40 in the direction indicated by arrow R (see FIG. 1) to a rearward position compressing the recoil springs. The distance of travel is indicated as dimension E in FIG. 2. The compressed recoil springs then return the inner frame 40 from the rearward position to the forwardmost position in the direction indicated by arrow F. The return springs 114, 116 counteract the returning force of the recoil springs 110, 112 and are provided for easing the return of the inner frame 40 from the rearward position to the forwardmost position.

Both the return and recoil springs are illustrated as compression springs, although it is apparent that tension springs could be used with proper attachment provided at the stop 64 and the carriage frame front and rear walls 46, 48. Typically, the recoil springs have a higher spring constant than that of the return springs, that is the recoil springs are "stronger" or "stiffer" than the return springs. The relative dimensions of the recoil and return chambers and the lengths of the return and recoil springs are chosen such that each set of springs is slightly compressed when assembled with the inner frame at a forwardmost initial position.

Figure 6:
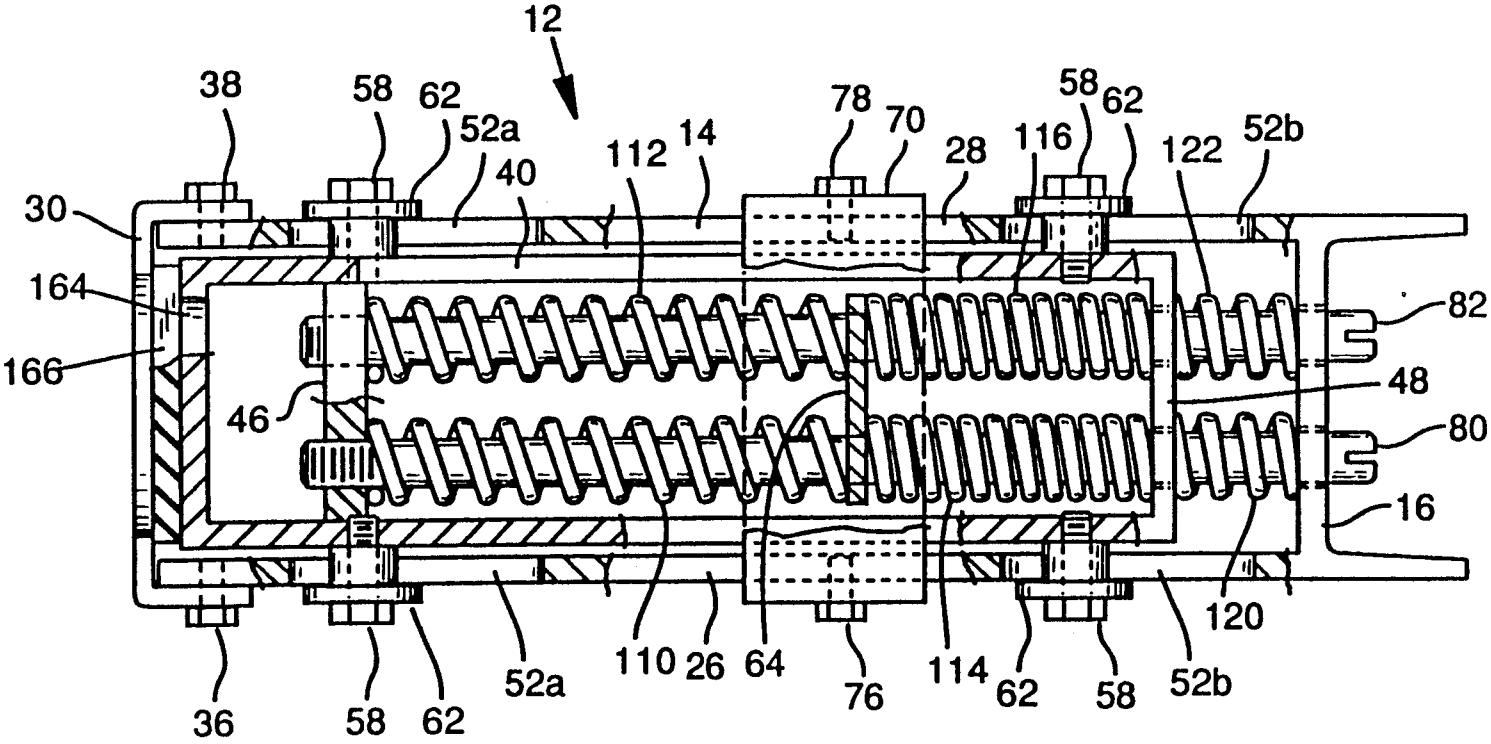
FIG. 6 is a partially cutaway top plan view of another form of the present invention.
Figure 9:
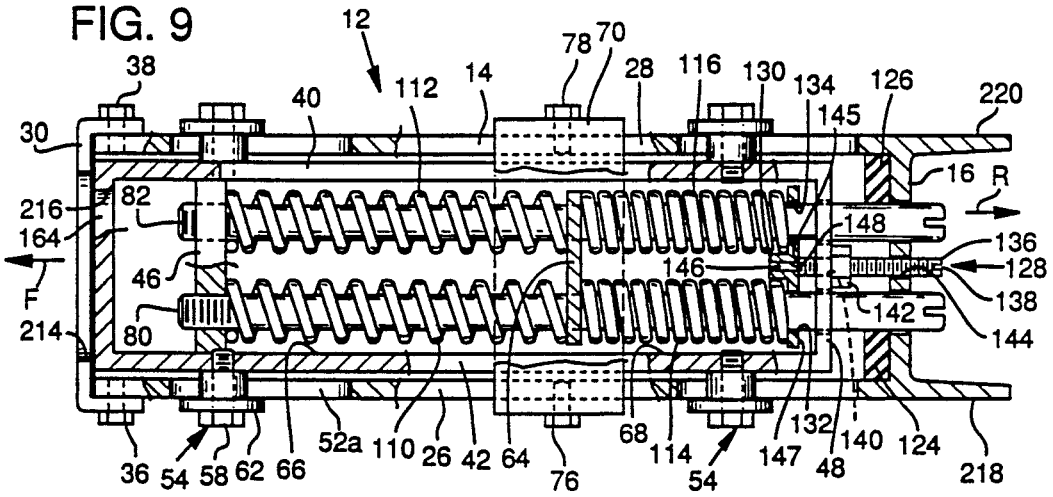
FIG. 9 is a partially cutaway top plan view of an another alternative form of the present invention.

With reference to FIGS. 6 and 9, two alternate embodiments are shown for the recoil energy absorbing means which further includes secondary recoil energy absorbing means located between the inner and outer frame rear walls 48 and 16. Referring to FIG. 6, the secondary recoil energy absorbing means comprises recoil assist springs 120, 122 which surround the respective rods 80, 82. For the embodiment described above wherein the recoil and return springs are slightly compressed in the initial state, the recoil assist springs 120, 122, which may also be compression springs, are sized for a loose or uncompressed fit. The lengths and strengths (spring constants) of the recoil, return and recoil assist springs may be varied to vary the maximum recoil which may be felt by a shooter for a given firearm and ammunition load.

In FIG. 9, the secondary recoil energy absorbing means comprises two resilient bumper pads 124, 126 attached to the stationary frame rear wall 16 adjacent the respective sidewalls 26, 28. The thickness and resilience of bumper pads 124, 126 may be varied depending upon the desired distance of travel E (see FIG. 2). The bumper pads may be of any suitable resilient material such as rubber or the like.

The recoil energy felt by a shooter using the device may be varied by the manner in which the shooter shoulders and grips the firearm and device. The maximum recoil which may be felt by a shooter may be adjusted by various recoil energy absorbing adjustment means for varying the rate of absorption of the recoil energy by the spring means. For example, the sizes and strengths of the recoil springs 110, 112 and the return springs 114, 116 may be chosen to control the maximum recoil. Thus, the maximum recoil which a user is to feel may be varied by changing the springs. In use, the recoil felt by a user may be progressively increased to teach a novice shooter basic shooting techniques while grasping the firearm in a conventional manner and without fearing the recoil. The choice of springs may also be made to control the rearward recoil travel to a desired distance E (see FIG. 2) for a given firearm and ammunition load.

Alternatively, the device may be provided with incremental recoil energy absorbing adjustment means 128, as shown in FIG. 9. The adjustment means 128 includes a spring compressing member 130 mounted within the return chamber 68 near the inner frame rear wall 48. The spring compressing member 130 has two holes 132 and 134 therethrough, which are sized and positioned to slidably receive guide rods 80 and 82 and to engage the return springs 114, 116.

The adjustment means 128 also includes a threaded rod 136 having a slot 138 at one end. The carriage frame rear wall 48 may have an internally threaded hole therethrough for threadably engaging rod 136 (not shown). Alternatively, the rear wall 48 may have a hole 140 which slidably receives rod 136, and a nut 142 welded to the rear wall adjacent hole 140 such that the nut threadably engages rod 136. The stationary frame rear wall 16 has a hole 144 therethrough which slidably receives rod 136.

At the end opposite slot 138, the threaded rod 136 has a shoulder 145 from which stub 146 extends. Stub 146 is of a lesser diameter than the threaded portion of rod 136. The spring compression member 130 has a rearward facing surface 147 and a hole 148 therethrough sized to rotatably engage stub 146 so that shoulder 145 may push against surface 147. Upon rotation of rod 136 at notch 138, the space between the rear wall 48 and the spring compressing member 130 is varied. An incremental adjustment means similar to 128 may be mounted within the recoil chamber 66 to vary the space between the inner frame front wall 46 and a spring compression member.

The recoil springs 110, 112 and the return springs 114, 116 are compressed by forcing the spring compressing member 130 toward stop 64, that is, in the forward direction F away from rear wall 48. This adjustment effectively decreases the overall effective length of the inner frame 40, with the relative decreases in length of the recoil and return chambers 66 and 68 being dictated by the relative strengths of the recoil and return springs. By decreasing the effective length of chambers 66 and 68 (using the illustrated compression springs 110, 112, 114 and 116), the distance of rearward travel E (see FIG. 2) is decreased and the rate of absorption of the recoil energy by the springs is increased.

Alternatively, external adjustment means may be added to the assembly to vary the rearward travel E and the rate of recoil energy absorption. For example, spacers, such as washers, may be inserted around the guide rods 80, 82 to vary the initial spring tension. The spacers may be mounted within the recoil chamber 66, the return chamber 68, or if the recoil assist springs 120, 122 are used, between the rear walls 48 and 16 (not shown).

Figure 7:
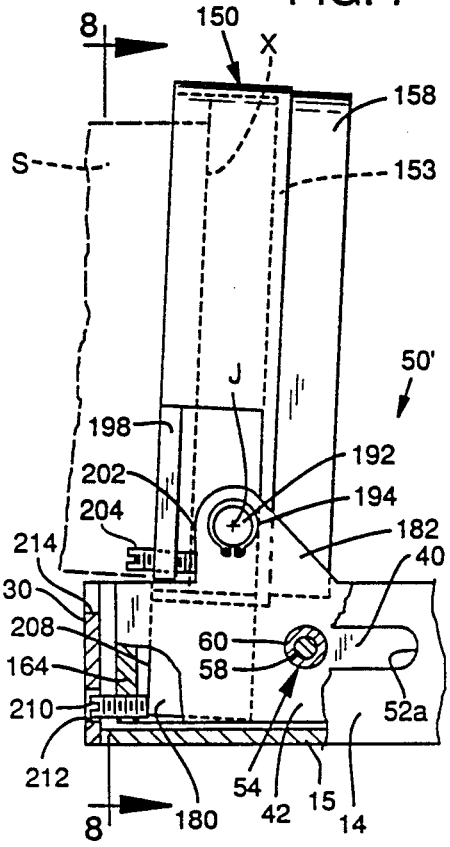
FIG. 7 is a cutaway partial side view of another form of the present invention showing an alternative embodiment with an adjustable butt cup.

Referring to FIG. 1, the illustrated firearm recoil absorbing device 10 may be used with a firearm G having a barrel end B, which terminates at a muzzle M, and a shoulder stock S which terminates at an end opposite muzzle M with a butt X (see FIG. 7). In the illustrated embodiments, the recoil absorbing device 10 is used with an external support means Z which supports the barrel end B. This external support means Z may simply be a block as illustrated, which may be adjusted vertically by shim means, sand bags (not shown), or the like. Alternatively, the external support means Z may be a shooter's hand. When using an external support means Z, the firearm receiving means 50 comprises means for receiving the firearm butt X.

Figure 2:
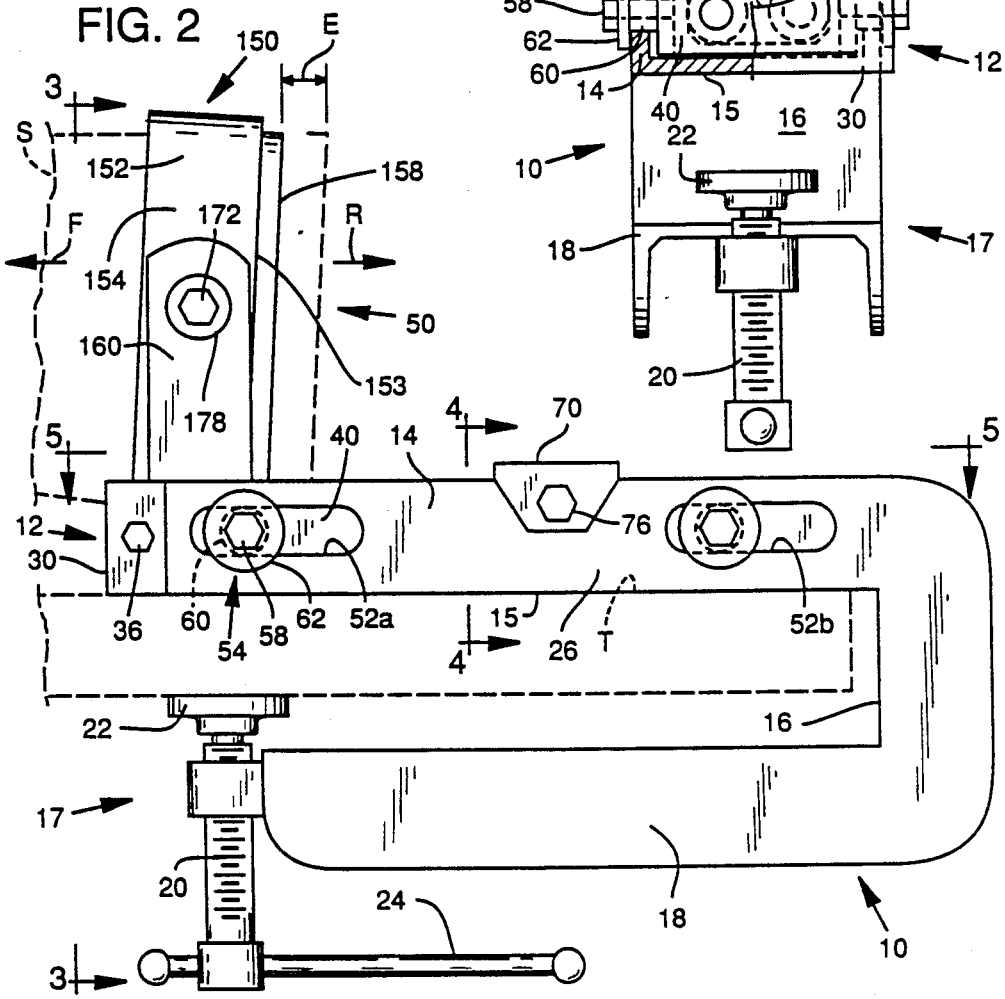
FIG. 2 is a detailed side elevational view of the FIG. 1 embodiment of the present invention.

Referring to FIGS. 1–3, one means for receiving the firearm butt has butt cup means such as a butt cup 150, for surrounding and receiving the firearm butt X. The butt cup 150 has an oblong band 152 which is enclosed at one edge by wall 153. The oblong band 152 is of a shape and size to cradle the butt end of a firearm stock S, and therefore has two opposing generally upright sides 154, 156.

The butt cup 150 may be internally lined with a soft cushioning material, such as rubber, cloth, or plastic (not shown), to protect the finish on stock S and cushion the impact of butt X against wall 153. The butt cup 150 also has a cushioned shoulder pad 158 attached to the external rearwardly facing surface of wall 153. Thus, if a shooter wishes to grip the firearm G in a conventional manner, the shooter may shoulder the firearm using a shoulder pad 158.

As shown in FIG. 1, the inner frame sidewalls 42, 44 extend forwardly beyond front wall 46 and then upwardly and outwardly from the inner frame 40 to form a pair of yoke-forming mounting flanges 160, 162. As shown in FIG. 5, 6 and 9, the bases of the forwardmost edge of mounting flanges 160, 162 are joined by a forwardmost stop wall 164. In FIG. 6, the upper recoil assembly 12 has a resilient front stop bumper pad 166 attached to the outer frame front wall 30 to cushion the impact of stop wall 164 against front wall 30 after firing. The front stop bumper pad 166 is of a resilient material, such as rubber.

As shown in FIGS. 1–3, the butt cup 150 is positioned between the mounting flanges 160 and 162. The means for receiving the firearm butt includes pivotal attachment means for pivotally attaching each mounting flange 160, 162 to the respective adjacent sides 154, 156 of butt cup 150. The illustrated pivotal attachment means includes two identical pivot assemblies **168*a* and 168*b* interconnecting the butt cup upright walls 154, 156 with the respective mounting flanges 160, 162**.

Referring to FIG. 3, the pivot assembly **168*a*, for example, includes the butt cup upright leg 154 having an internally threaded hole 170 therethrough, which threadably receives a bolt 172. The yoke-forming mounting flange 160 has a hole 174 therethrough sized to receive a roller element or bushing 176, which surrounds the shank of bolt 172. A washer 178 may be provided between the head of bolt 172 and mounting flange 160. The pivot assemblies 168*a* and 168*b* allow the pivotal motion of the butt cup 150 about a pivot axis H which is substantially parallel to the test surface T. In this manner the butt cup 150** is self-aligning in that any vertical adjustment of the muzzle M is provided by vertically adjusting the external support block Z, such as by adding shims beneath block Z.

Figure 8:
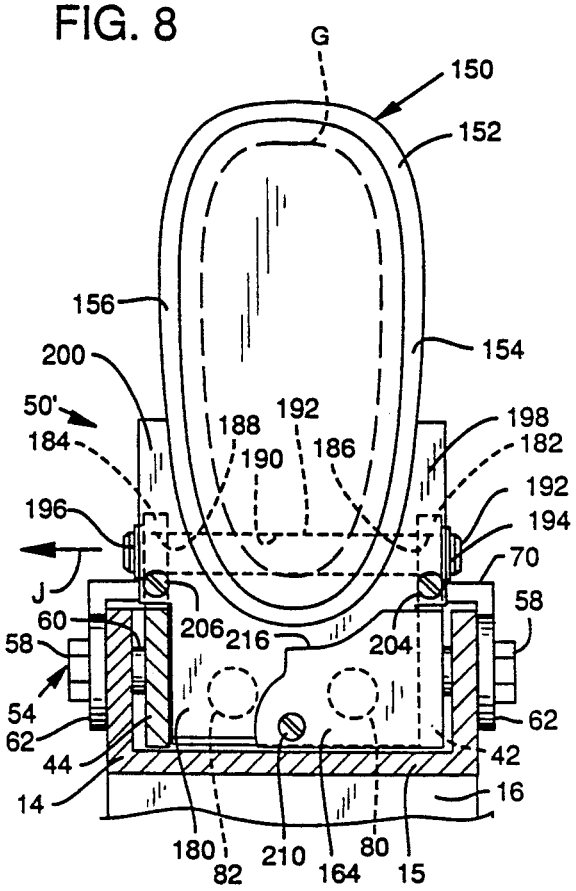
FIG. 8 is a partially cutaway front elevational view taken along 8—8 of FIG. 7.

FIGS. 7 and 8 illustrate an alternate means 50' for receiving the firearm butt which includes adjustable butt cup means having a butt cup 150 as described above. The adjustable butt cup means includes a downwardly extending mounting member, such as mounting block 180, to which butt cup 150 attached, such as by welding. The inner frame sidewalls 42, 44 extend forwardly and upwardly beyond front wall 46 to form respective mounting flanges 182, 184, each having a respective hole 186, 188 therethrough. The mounting block 180 has a transverse pivot pin hole 190 therethrough.

A pivot pin 192 extends through holes 186, 190 and 188 to pivotally attach the mounting block 180 to the inner frame 40 for pivotal motion of the butt cup 150 about a pivot axis J which is substantially parallel to the bench or test surface T. The pivot pin 192 has an external retaining ring groove at each end, located external to each mounting flange 182 and 184, which receives the respective external retaining ring 194, 196 to secure the pivot pin in place.

The adjustable butt cup means has alignment means including at least one and preferably both of the butt cup upright sides 154 and 156 having an upper alignment means engaging member, such as respective ears 198 and 200, projecting outwardly therefrom. In the illustrated embodiment, ears 198 and 200 are integral with mounting block 180. Each mounting flange 182, 184 has a substantially upright front edge which forms an upper alignment face, such as face 202 of flange 182 in FIG. 7 which extends upwardly from the inner frame sidewall 42. Each upper alignment face is located at a spaced apart distance from the respective ear. Each ear 198, 200 has an internally threaded hole therethrough, located just below pivot pin 192, which threadably receives upper adjustable alignment means, such as respective upper set screws 204 and 206.

The adjustable butt cup alignment means further includes the mounting member 180 having a lower alignment face 208 facing in a forward direction. The lower alignment face 208 is located well below pivot axis J, near the outer frame lower wall 15. The alignment means also includes a lower alignment means engaging member comprising the inner frame stop wall 164 which is located at a spaced apart distance from face 208. The stop wall has an internally threaded hole therethrough, which threadably receives lower adjustable alignment means, such as set screw 210. The outer frame front wall 30 has a hole 212 therethrough which provides easy access to set screw 210.

The upper and lower set screws 204, 206 and 210 engage the respective upper and lower alignment faces to vary the spaced apart distance therebetween. Thus, by adjusting the set screws 204, 206 and 210, an angle of pivotal attachment of the butt cup 150 relative to the test surface T (not shown) may be varied and fixed at a given adjustment prior to firing. In this manner, the butt cup means is adjustable to provide vertical adjustment of the muzzle M in cooperation with the external support means Z.

A low profile device 10 may be provided wherein the butt cup 150 extends slightly below the upper edge of the outer frame sidewalls 26 and 28. In such a low profile device 10, the outer frame front wall 30 and inner frame stop wall 164 each have a respective downwardly curved upper edge 214, 216 (see FIGS. 3, 5, 7 and 8).

Additionally, the device may include a removable housing cover (not shown) which covers the outer frame 14. Such a housing cover protects the moving parts from being jammed by contaminants, such as a shooter's clothes or brass ejected from the firearm after firing.

Furthermore, the outer frame sidewalls 26 and 28 may include respective rearward extensions 218 and 220 which protect a user of the device from being hit by rods 80, 82 as they move in a rearward direction R upon firing. The housing mentioned above may also cover and enclose the area between extensions 218 and 220.

In a typical application, the portable firearm recoiling absorbing device 10 may be transported to a shooting range. The device 10 is attached to a shooting bench or table T by tightening the bench-engaging platform 22 of C-clamp fastener 17 against the lower surface of the bench T using handle 24. The firearm G is then received by the butt cup 150 and the muzzle is supported on a block or sand bags Z. Only the external support Z is vertically adjusted to bring the firearm on target if the self-aligning butt cup means 50 of FIGS. 1 through 3 is used. If the adjustable butt cup means 50' of FIGS. 7 and 8 is used, both the external support Z and the butt cup are adjusted to bring the firearm G on target. When a shooter is done test firing a first firearm, it is apparent that a second firearm may quickly be set-up for testing with minimal adjustment of the butt cup and external support.

Having illustrated and described the principles of my invention in respect to the preferred embodiments, it should be apparent to those skilled in the art that my invention may be modified in arrangement and detail without departing from such principles. For example, the recoil energy absorbing spring means may be hydraulic or pneumatic devices. Also, the firearm support means may be modified to receive other types of firearms, such as pistols or handguns, and the device may be used without external barrel support means Z. Similarly, if a permanent installation is desirable, the C-clamp type clamping means 17 may be omitted and the upper recoil assembly 12 permanently affixed to the test surface T. I claim all such modifications falling within the spirit and scope following claims.

I claim:

1. A firearm recoil absorbing device for supporting a firearm during firing, comprising:

nested inner and outer frames, the inner frame being slidably connected to the outer frame for relative sliding motion between the nested frames, each of the inner and outer frames having two opposing sidewalls interconnected by a front wall, with the sidewalls of the inner frame being shorter in length than the sidewalls of the outer frame;

firearm receiving means extending upwardly from the inner frame for receiving the firearm;

recoil energy absorbing spring means resiliently coupling the inner and outer frames for absorbing the recoil energy from the firearm during firing; and roller means attached to one of the inner and outer frames for slidably engaging adjacent respective said sidewalls of the other of the inner and outer frames to allow the relative sliding motion between the nested frames.

2. A firearm recoil absorbing device according to claim 1 wherein the roller means comprises:

each said sidewall of the outer frame having a longitudinal slot therethrough; and each said sidewall of the inner frame having a roller extending outwardly therefrom which rollingly engages the longitudinal slot of the adjacent outer frame sidewall.

3. A firearm recoil absorbing device according to claim 1 for supporting a firearm which generates a rearwardly directed recoil energy during firing, the device further comprising:

the sidewalls of each said frame being interconnected by a rear wall opposite the respective front wall, with the rear walls of each said frame having a rod engaging hole therethrough, each said hole being concentric about a first longitudinal axis which is substantially parallel with the sidewalls of each said frame;

a rod having a longitudinal axis collinear with the first longitudinal axis, the rod being demountably attached to the inner frame front wall and sized to slidingly extend through the rod engaging holes of each said frame when the inner frame is in a forwardmost position toward the outer frame front wall;

inner frame divider means rigidly mounted to the outer frame and extending into the inner frame for dividing a space within the inner frame defined by the inner frame sidewalls in combination with the inner frame front and rear walls into a recoil chamber and a return chamber located respectively toward the front and rear walls, the divider means slidably receiving the rod; and wherein the recoil energy absorbing spring means includes:

(a) recoil spring means surrounding the rod in the recoil chamber for absorbing the rearwardly directed recoil energy during firing as the rearwardly directed recoil energy forces the inner frame from the forwardmost portion to a rearward position, and for returning the inner frame from the rearward position to the forwardmost position; and (b) return spring means surrounding the rod in the return chamber for easing a return travel of the inner frame from the rearward position to the forwardmost position by the recoil spring means.

4. A firearm recoil absorbing device according to claim 1 further including:

adjustment means mounted to the inner frame for varying the rate of recoil energy absorption by the recoil energy absorbing spring means; and self-contained mounting means for mounting the outer frame to a test surface, whereby the device is portable for use at various locations.

5. A firearm recoil absorbing device for supporting during firing a firearm having a barrel end terminating at a muzzle and a shoulder stock with a butt, the device comprising:

nested inner and outer frames, the inner frame being slidably connected to the outer frame for relative sliding motion between the nested frames, with each of the inner and outer frames having two opposing sidewalls interconnected by a front wall;

firearm receiving means adjacent the inner frame front wall and extending upwardly from the inner frame for receiving the firearm, the firearm receiving means comprising means for receiving the firearm butt; and recoil energy absorbing spring means resiliently coupling the inner and outer frames for absorbing the recoil energy from the firearm during firing.

6. A firearm recoil absorbing device according to claim 5 wherein the means for receiving the firearm butt further comprises:

a pair of yoke-forming mounting flanges extending upwardly from the inner frame;

butt cup means positioned between the pair of mounting flanges for surrounding and receiving the firearm butt, including two opposing generally upright sides; and pivotal attachment means for pivotally attaching each mounting flange to the respective adjacent generally upright side of the butt cup means for pivotal motion of the butt cup means about a pivot axis which is substantially parallel with a test surface upon which the device rests, so as to provide vertical adjustment of the muzzle by vertically adjusting external support means provided for supporting the barrel end, with the butt cup means being self-aligning in response to said vertical adjustment.

7. A firearm recoil absorbing device according to claim 5 wherein the means for receiving the firearm butt further comprises:

butt cup means for surrounding and receiving the firearm butt, including two opposing generally upright sides, with at least one of said upright sides having an upper alignment means engaging member projecting outwardly therefrom, the butt cup means also including a downwardly extending mounting member having a lower alignment face;

pivotal attachment means for pivotally attaching the mounting member to the inner frame sidewalls for pivotal motion of the butt cup means about a pivot axis which is substantially parallel with a test surface upon which the device rests;

at least one upper alignment face extneding upwardly from the inner frame and located at a spaced apart distance from the upper alignment means engaging member;

the inner frame including a lower alignment means engaging member located at a spaced apart distance from the lower alignment face; and upper and lower adjustable alignment means extending from the respective upper and lower alignment means engaging members for engaging the respective upper and lower alignment faces to vary the spaced apart distances therebetween and for variably fixing an angle of pivotal attachment of the butt cup means relative to the test surface, so as to provide vertical adjustment of the muzzle by adjusting the butt cup means in cooperation with external support means provided for supporting the barrel end.

8. A firearm recoil absorbing device for supporting a firearm which generates a recoil energy in a rearward direction during firing, comprising:

a frame;

a stop mounted to the frame;

firearm support means slidably mounted to the frame for receiving the firearm aimed in a forward direction opposite the rearward direction;

first recoil absorbing spring means positioned between the stop and a first portion of the firearm support means for absorbing recoil energy as the support means slides in the rearward direction as a result of firing the firearm;

second recoil absorbing spring means positioned between the stop and a second portion of the firearm support means for absorbing energy as the support means returns in the forward direction following firing;

a rod mounted to the firearm support means and slidably engaging the stp and the frame, the rod having a longitudinal axis substantially parallel with the slidable movement of the firearm support means in the forward and rearward directions; and wherein the first and second recoil absorbing spring means respectively comprise a recoil spring and a return spring, with each spring surrounding the rod.

9. A firearm recoil absorbing device according to claim 8 further comprising adjustment means mounted to the firearm support means for varying the rate of energy absorption by the first and second recoil absorbing spring means.

10. A firearm recoil absorbing device according to claim 8 for a firearm having a barrel end terminating at a muzzle and a shoulder stock which terminates at a butt, wherein the firearm support means comprises self-aligning butt cup means for receiving the firearm butt, so as to provide vertical adjustment of the muzzle by vertically adjusting external support means provided for supporting the barrel end, with the butt cup means being self-aligning in response to said vertical adjustment.

11. A firearm recoil absorbing device according to claim 8 for a firearm having a barrel end terminating at a muzzle and a shoulder stock which terminates at a butt, wherein the firearm support means comprises adjustable butt cup means for freely receiving the firearm butt to provide vertical adjustment of the muzzle in cooperation with external support means provided for supporting the barrel end.

12. A firearm recoil absorbing device for supporting a firearm which generates a recoil energy in a rearward direction during firing, comprising:

a frame;

a stop mounted to the frame;

firearm support means slidably mounted to the frame for receiving the firearm aimed in a forward direction opposite the rearward direction;

first recoil absorbing device spring means positioned between the stop and a first portion of the firearm support means for absorbing recoil energy as the support means slides in the rearward direction as a result of firing the firearm;

second recoil absorbing spring means positioned between the stop and a second portion of the firearm support means for absorbing energy as the support means returns in the forward direction following firing;

the frame is stationary and has two opposing sidewalls interconnected by a front wall, each said sidewall having roller supporting means;

the firearm support means comprises a slidable carriage frame; and the device further includes roller means mounted to the carriage frame for slidably engaging the roller supporting means to allow the carriage frame to slide substantially parallel to the stationary frame sidewalls.

13. A firearm recoil absorbing device according to claim 12 wherein:

the roller supporting means comprises each said sidewall of the stationary frame having a longitudinal slot therethrough; and the roller means comprises each said sidewall of the carriage frame having a roller extending outwardly therefrom which rollingly engages the longitudinal slot of the adjacent stationary frame sidewall.

14. A firearm recoil absorbing device according to claim 12 wherein the carriage frame is nested within the stationary frame.

15. A portable firearm recoil absorbing device for supporting a firearm which generates a rearwardly directed shock during firing, comprising:

a frame;

firearm support means mounted to the frame for receiving the firearm;

shock absorbing means mounted to the frame for absorbing the shock during firing; and C-clamp means mounted to the frame for releasably wedging therebetween one of a variety of shooting benches having varying thicknesses.

16. A portable firearm recoil absorbing device for supporting a firearm which generates a rearwardly directed shock during firing, comprising:

a frame which is stationary and has two opposing sidewalls interconnected by a front wall, each said sidewall having roller supporting means;

firearm support means mounted to the frame for receiving the firearm, the firearm support means comprising a slidable carriage frame having roller means for slidably engaging the roller supporting means to allow the carriage frame to slide relative to the stationary frame;

shock absorbing means mounted to the frame for absorbing the shock during firing; and clamping means mounted to the frame for releasably clamping the device to a test surface.

17. A portable firearm recoil absorbing device according to claim 16 further including:

a stop mounted to the frame;

guide means extending through the stop for supporting and guiding the shock absorbing means; and wherein the shock absorbing means includes recoil spring means for absorbing the shock during firing as the carriage frame moves from an initial position to a second position and for returning the carriage frame from the second position to the initial position, and the shock absorbing means further includes return spring means for easing a return of the carriage frame from the second position to the initial position, the recoil and return spring means supported by the guide means on opposite sides of the stop.

18. A portable firearm recoil absorbing device according to claim 16 wherein the clamping means comprises a C-clamp.

* * * * *